US005080376A

United States Patent [19]

Lerner et al.

[11] Patent Number: 5,080,376

[45] Date of Patent: Jan. 14, 1992

[54] TETHER BALL

[76] Inventors: Reuven Lerner, 11 Nordau Blvd., Tel Aviv; Moshe Lugasi, 66 Macabee Street, Raanana, both of Israel

[21] Appl. No.: 729,769

[22] Filed: Jul. 15, 1991

[51] Int. Cl.[5] ..... A63B 43/02; A63B 69/26

[52] U.S. Cl. ..... 273/411; 273/58 C; 273/DIG. 19; 273/414

[58] Field of Search ..... 273/58 C, 411, 184 B, 273/185 C, 198, 329, 328, 330, 319, DIG. 19, 414

[56] References Cited

U.S. PATENT DOCUMENTS

| | | | |
|---|---|---|---|
| 2,688,202 | 9/1954 | O'Neill | 273/58 C |
| 3,220,729 | 11/1965 | Whittington | 273/58 C |
| 3,729,195 | 4/1973 | Hutt et al. | 273/58 C |
| 4,162,790 | 7/1979 | Kelsey | 273/58 C |
| 4,240,629 | 12/1980 | Song et al. | 273/58 C |
| 4,687,209 | 8/1987 | Carey | 273/411 |

*Primary Examiner*—George J. Marlo
*Attorney, Agent, or Firm*—Benjamin Barish

[57] ABSTRACT

The tether cord is secured to the ball by a stud having an enlarged head engaging the external surface of the ball, and a shank passing through an opening in the ball and formed with a shoulder engaging the inner surface of the ball. The underface of the enlarged head is formed with a cavity for receiving one end of the tether cord, and with a bore extending from the cavity to the outer surface of the enlarged head through which the tether cord passes. The cavity is eccentric with respect to the enlarged head, and the outer end of the bore is centric with respect to the enlarged head.

11 Claims, 1 Drawing Sheet

TETHER BALL

FIELD AND BACKGROUND OF THE INVENTION

The pre invention relates to amusement or exercising devices, and particularly to a ball having a tether cord secured thereto such as used in playing various types of games or performing various types of athletic exercises.

One type of tether ball popular in training players for the game of soccer includes an inflated soccer ball to which one end of a tether cord is secured, the opposite end of the tether cord being formed with a loop for application around the waist of the player. In the conventional construction, the tether cord is secured to the tether ball by a plastic disc or patch bonded over the end of the tether cord and to the outer face of the ball. However, such a construction does not securely fix the end of the tether cord to the ball particularly when the ball is sharply hit.

OBJECTS AND SUMMARY OF THE INVENTION

An object of the present invention is to provide a tether ball of a construction which more firmly secures the tether to the ball.

According to the present invention, there is provided a ball and a tether cord secured thereto, characterized in that the tether cord is secured to the ball by a stud having an enlarged head engaging the external surface of the ball, and a shank passing through an opening in the ball and formed with a shoulder engaging the inner surface of the ball. The underface of the enlarged head of the stud is formed with a cavity for receiving one end of the tether cord, and with a bore extending from the cavity to the outer surface of the enlarged head through which the tether cord passes.

According to further features in the preferred embodiment of the invention described below, the cavity is eccentric with respect to the enlarged head, and the outer end of the bore is centric with respect to the enlarged head.

According to still further features in the preferred embodiment of the invention described below, the ball is inflatable and is integrally formed with a hollow stem extending internally of the ball and coaxial with the opening. The shank of the stud extends through the hollow stem; and the shoulder in the shank is an annular shoulder engaging the inner end of the hollow stem.

According to still further features in the described preferred embodiment, the shank includes: a first conical section gradually decreasing in diameter from the enlarged head; a second conical section more sharply decreasing in diameter from the first conical section towards, and terminating in, the annular shoulder; and a third conical section even more sharply decreasing in diameter starting from the annular shoulder and terminating in a pointed tip. The first conical section is of larger length than the second conical section, and the second conical section is of larger length than the third conical section.

As will be more readily apparent from the description below, a tether ball constructed in accordance with the foregoing features provides a very strong securement of the tether cord to the ball.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
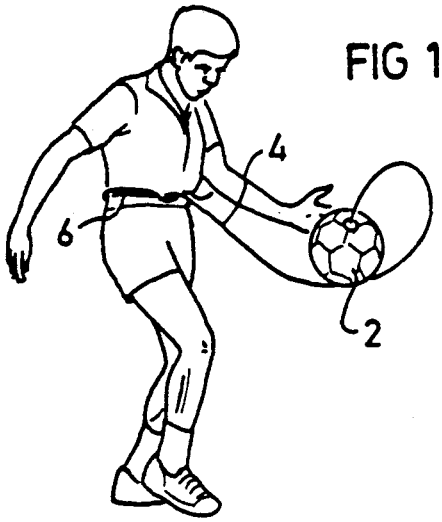
FIG. 1 illustrates one form of tether ball constructed in accordance with the present invention particularly useful for training soccer players in ball handling.

FIG. 1 illustrates one type of tether ball particularly useful for training soccer players in ball handling. The illustrated tether ball thus includes an inflated soccer ball 2 to which one end of a tether cord 4 is secured, the opposite end of the tether cord being formed with a loop 6 applied around the waist of the player. The tether cord 4 is of a length such that it will always maintain the ball close to the player as the player repeatedly kicks the ball to keep the ball in constant motion over the ground.

Figure 2:
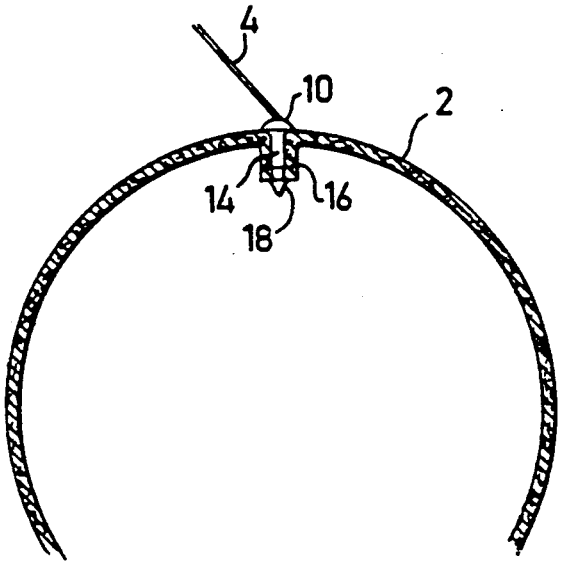
FIG. 2 is a transverse sectional view illustrating the ball of FIG. 1 and the end of the tether cord secured thereto.
Figure 3:
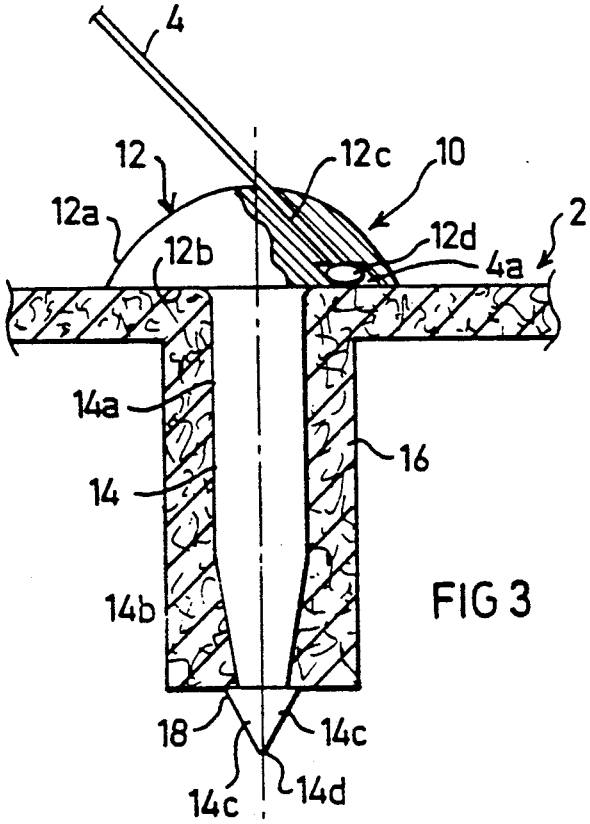
FIG. 3 is an enlarged fragmentary view more particularly illustrating the manner of securing the end of the tether cord to the ball.

As shown particularly in FIGS. 2 and 3, the end of the tether cord 4 is secured to the ball 2 by means of a stud, generally designated 10, having an enlarged head 12 engaging the outer surface of the ball 2. Stud 10 includes a shank 14 passing through a hollow stem 16 integrally formed with the ball 2 and terminates in an annular shoulder 18 engaging the inner end of the hollow stem.

More particularly, as shown in FIG. 3, the enlarged head 12 of the stud 10 is formed with an outer surface **12*a* of substantially semi-spherical configuration, and with an inner flat surface 12*b* which engages the outer surface of the ball 2. The enlarged head 12 is further formed with a cavity 12*c*, starting from its inner face, and leading to a bore 12*c* extending from the cavity to the outer face of the enlarged head. Bore 12*d* is inclined with respect to the longitudinal axis of the stud 10. Its cavity 12*c* is located eccentrically with respect to the longitudinal axis of the stud, and the outer end of its bore 12*d*** is located substantially centrically (i.e., coaxially) of the longitudinal axis of the stud.

Shank 14 of stud 10 is formed with a first conical section **14*a* gradually decreasing in diameter from the enlarged head 12; a second conical section 14*b* more sharply decreasing in diameter towards, and terminating in, the annular shoulder 18; and a third conical section 14*c* even more sharply decreasing in diameter, starting from the annular shoulder 18 and terminating in a pointed tip 14*d*. As clearly seen in FIG. 3, conical section 14*a* is of larger length than conical section 14*b*, and the latter is of larger than the conical section 14*c***.

As one example, the thickness of the enlarged head 12 may be 8 mm; the length of conical section **14*a* may be 13 mm, the length of conical section 14*b* may be 7 mm, and the length of conical section 14*c* may be 3 mm. In addition, the diameter of conical section 14*a* may decrease from about 3 mm to about 2.8 mm, and the diameter of conical section 14*b* may decrease to a diameter of 2 mm at the annular shoulder; the annular shoulder may have a diameter of 3.5 mm; and the enlarged head 12** may have a diameter of 27 mm.

It will be seen that the tether cord 4 may be easily secured to the ball 2 by enlarging (e.g., by knotting) the end of the tether 4 cord 4, as shown at 4*a*, passing the tether cord through the bore 12*d* so that the enlarged end 4*a* of the tether cord is anchored within the cavity 12*c*; and then forcefully inserting the shank 14 of the stud 12 through the hollow stem 16 until the annular shoulder 18 of the shank engages the inner end of the hollow stem. The tether is thus firmly secured to the ball. Moreover, since the cavity 12*c* receiving the end of the tether 4 is eccentric with respect to the longitudinal axis of the stud 10, the forces applied to the tether cord 4 will produce a rotary moment of the stud with respect to the hollow stem 16, rather than a force parallel to the longitudinal axis of the stud which would tend to force the stud out of the hollow stem. The arrangement thus securely attaches the tether cord 4 to the ball 2.

The hollow stem 16 may also be used for inflating the soccer ball; alternatively, another hollow stem may be provided at the opposite end of the ball for purposes of inflating the soccer ball. The cord 4 may be elastic or non-elastic.

While the invention has been described with respect to one preferred embodiment, it will be appreciated that this embodiment is described merely for purposes of example, and that many variations, modifications and other applications of the invention may be made.

What is claimed is:

1. A ball and a tether cord secured thereto, characterized in that said tether cord is secured to the ball by a stud having an enlarged head engaging the external surface of the ball, and a shank passing through an opening in the ball and formed with a shoulder engaging the inner surface of the ball, the underface of said enlarged head being formed with a cavity for receiving one end of the tether cord, and with a bore extending from said cavity to the outer surface of the enlarged head through which said tether cord passes.

2. The ball and tether cord according to claim 1, wherein said cavity is eccentric with respect to said enlarged head, and the outer end of said bore is centric with respect to said enlarged head.

3. The ball and tether cord according to claim 1, wherein said ball is inflatable and is integrally formed with a hollow stem extending internally of the ball and coaxial with said opening; the shank of said stud extending through said hollow stem; said shoulder in the shank being engageable with the inner end of said hollow stem.

4. The ball and tether cord according to claim 3, wherein said shoulder is an annular shoulder engaging the inner end of said hollow stem.

5. The ball and tether cord according to claim 4, wherein said shank includes: a first conical section gradually decreasing in diameter from said enlarged head; a second conical section more sharply decreasing in diameter from said first conical section towards, and terminating in, said annular shoulder; and a third conical section even more sharply decreasing in diameter starting from said annular shoulder and terminating in a pointed tip.

6. The ball and tether cord according to claim 5, wherein said first conical section is of larger length than said second conical section, and said second conical section is of larger length than said third conical section.

7. The ball and tether cord according to claim 1, wherein said tether includes a loop at its end opposite to that secured to the ball.

8. An amusement or exercising device comprising:

an inflatable ball integrally formed with a hollow stem extending internally of the ball;

a stud having an enlarged head engaging the external surface of the ball, and a shank passing through said hollow stem and terminating in an annular shoulder engaging with the inner end of said hollow stem;

the underface of said enlarged head being formed with a cavity, and with a bore extending from said cavity to the outer surface of the enlarged head;

said cavity being eccentric with respect to said enlarged head, and the outer end of said bore being centric with respect to said enlarged head;

and a tether cord having one end received within said cavity of the stud head, and passing through said bore thereof.

9. The device according to claim 8, wherein said shank includes: a first conical section gradually decreasing in diameter from said enlarged head; a second conical section more sharply decreasing in diameter from said first conical section towards, and terminating in, said annular shoulder; and a third conical section even more sharply decreasing in diameter starting from said annular shoulder and terminating in a pointed tip.

10. The device according to claim 9, wherein said first conical section is of larger length than said second conical section, and said second conical section is of larger length than said third conical section.

11. The ball and tether cord according to claim 10, wherein said tether cord is formed with a loop at its end opposite to that secured to the ball.

* * * * *